US005199649A

United States Patent [19]

Tolboll

[11] Patent Number: 5,199,649

[45] Date of Patent: Apr. 6, 1993

[54] SPRAY NOZZLE

[75] Inventor: Steen Tølboll, Hølte, Denmark

[73] Assignee: Hardi International A/S, Denmark

[21] Appl. No.: 740,065

[22] Filed: Aug. 5, 1991

[51] Int. Cl.[5] ..... B05B 1/00

[52] U.S. Cl. ..... 239/600; 239/591; 239/597

[58] Field of Search ..... 277/236; 285/917, 202, 285/204; 239/DIG. 19, 600, 599, 596, 597, 598, 591, 550, 568; 403/288

[56] References Cited

U.S. PATENT DOCUMENTS

| | | | |
|---|---|---|---|
| 1,516,397 | 11/1924 | Mueller et al. | 277/236 |
| 2,528,665 | 11/1950 | Peterson et al. | 285/917 |
| 2,683,627 | 7/1954 | Wahlin | 239/597 |
| 3,447,756 | 6/1969 | Lawrence, Jr. | 239/568 |
| 3,754,710 | 8/1973 | Chimura | 239/597 |
| 3,779,462 | 12/1973 | Bruninga . | |
| 4,130,247 | 12/1978 | Healy . | |
| 4,139,160 | 2/1979 | Rood . | |
| 4,570,858 | 2/1986 | Bintner et al. . | |
| 4,645,127 | 2/1987 | Emory et al. | 239/600 |
| 4,706,889 | 11/1987 | Hofmann | 239/550 |
| 4,736,892 | 4/1988 | Calder | 239/600 |
| 4,988,043 | 1/1991 | Lechler | 239/600 |
| 5,050,633 | 9/1977 | Courson | 239/550 |
| 5,060,869 | 10/1991 | Bekius | 239/600 |
| 5,108,034 | 4/1992 | Huey et al. | 239/550 |

FOREIGN PATENT DOCUMENTS

| | | | |
|---|---|---|---|
| 0117023A1 | 8/1984 | European Pat. Off. . | |
| 2202346 | 7/1973 | Fed. Rep. of Germany | 239/596 |
| 2700028 | 9/1977 | Fed. Rep. of Germany . | |
| 2755993 | 6/1978 | Fed. Rep. of Germany . | |
| 3632005A1 | 4/1988 | Fed. Rep. of Germany . | |
| 2637819A1 | 4/1989 | France . | |
| 2085759 | 5/1982 | United Kingdom . | |
| 2224222A | 5/1990 | United Kingdom . | |

*Primary Examiner*—Andres Kashnikow
*Assistant Examiner*—Christopher G. Trainor
*Attorney, Agent, or Firm*—Hill, Steadman & Simpson

[57] ABSTRACT

A spray nozzle assembly, especially for spraying liquid manure, has a nozzle body which can be inserted in and fastened to a pipe stud by means of a union suitable for dye coding so that the nozzle can be easily identified. The nozzle body is surrounded by a circumferential metal sealing disk pressed into the union with the rim of the disk cutting into the inner wall of the union during the pressing step.

4 Claims, 9 Drawing Sheets

SPRAY NOZZLE

FIELD OF THE INVENTION

The invention relates to a spray nozzle, especially for spraying liquid manure, comprising a nozzle body which can be inserted in and fastened by means of a union, whereby said union is suitable for dye coding of the nozzle.

BACKGROUND ART

U.S. Pat. No. 4,139,160 discloses a spray nozzle where the nozzle body is inserted in a nozzle tip holder. A seal between the nozzle body and the nozzle tip holder is provided by a specially shaped tapered bushing.

SUMMARY OF THE INVENTION

An object of the invention is to fasten the nozzle body to the union in such a manner that said union can be used for marking purposes. In addition, the invention provides a tight seal between the nozzle body and the union which is simple to manufacture.

According to the invention, a spray nozzle of the above type is characterized in that the nozzle body has a circumferential metal sealing disc which is pressed into the union and thereby secured thereto, by outting into the union.

As a result, a spray nozzle is obtained which is completely tight and nevertheless simple to manufacture and a large surface is obtained for the dye coding in such a manner that the size of the nozzle is easily read under poorly illuminated conditions, and by far-sighted persons.

The nozzle is pressed into a through opening in the nozzle body and said through opening is provided with oblique side surfaces serving as guides for the nozzle during the pressure step. The nozzle has planar side surfaces corresponding with the side surfaces.

BRIEF DESCRIPTION OF THE DRAWINGS

The invention is described in greater detail below with reference to the accompanying drawings, in which.

DESCRIPTION OF PREFERRED EMBODIMENTS

Figure 1:
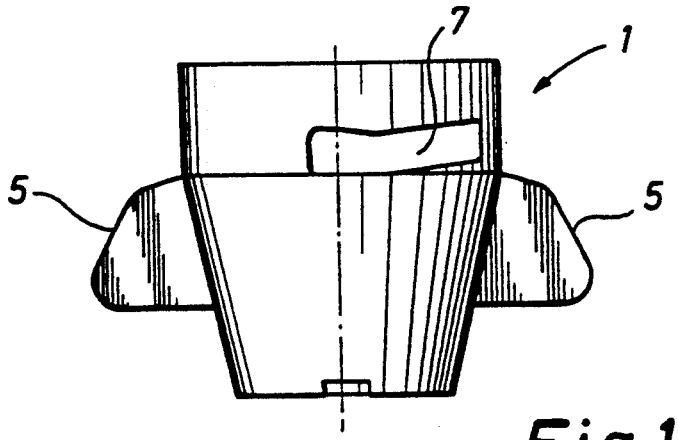
FIG. 1 is a side elevational view of the union of a spray nozzle according to the invention.
Figure 2:
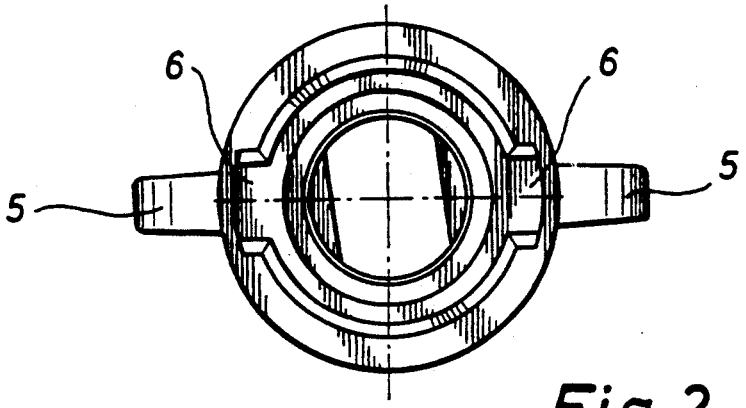
FIG. 2 is a top plan view of the union of FIG. 1.
Figure 3:
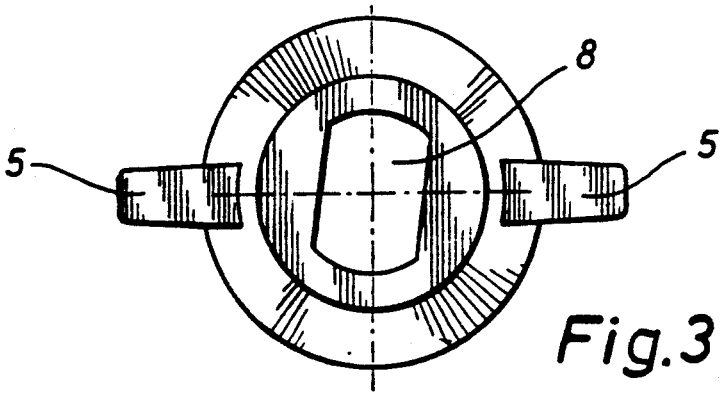
FIG. 3 is a bottom plan view of the union of FIG. 1.
Figure 4:
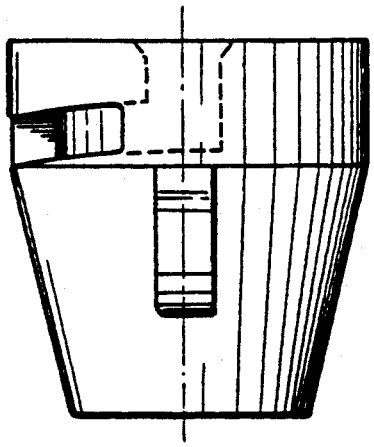
FIG. 4 is a side view of the union of FIG. 1 turned 90°.
Figure 5:
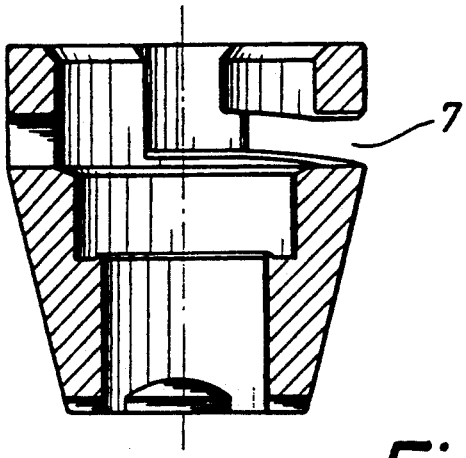
FIG. 5 is a longitudinal cross sectional view of the union.
Figure 6:
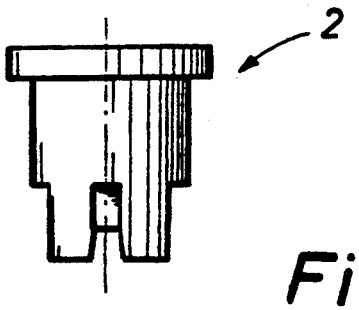
FIG. 6 is a side elevational view of the nozzle body to be inserted in the union of FIG. 5.
Figure 7:
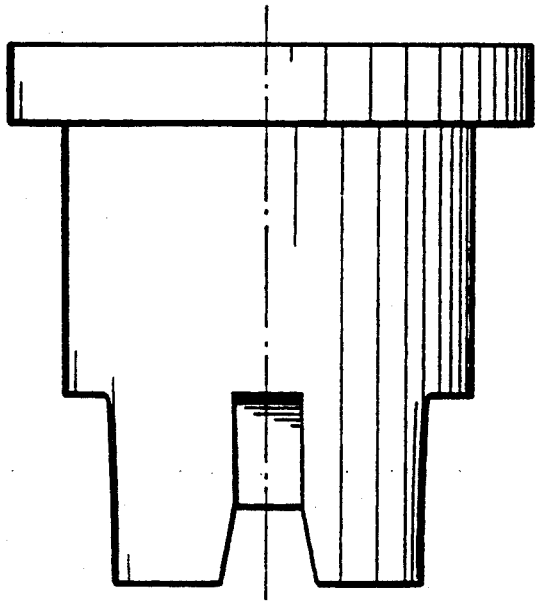
FIG. 7 is a side elevational view of the nozzle body of the nozzle body of FIG. 6 to be inserted in the union of FIG. 5.
Figure 8:
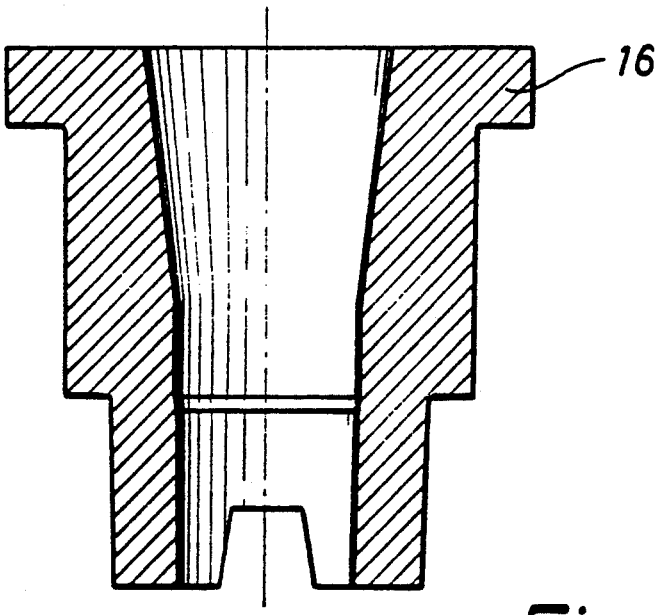
FIG. 8 is a longitudinal cross sectional view of the nozzle body of FIGS. 6 and 7.
Figure 10:
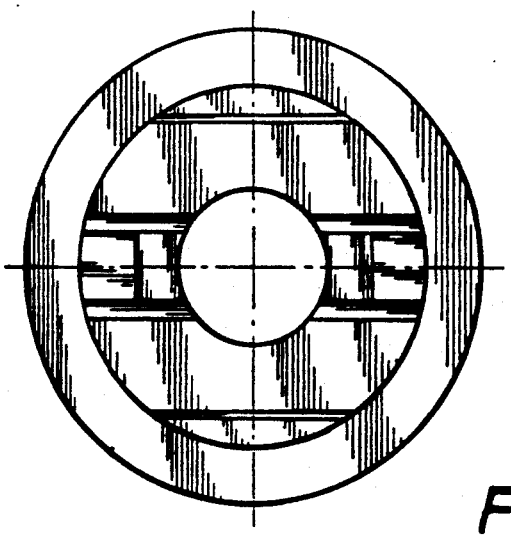
FIG. 10 is a top plan view of the nozzle body of FIG. 9.
Figure 12:
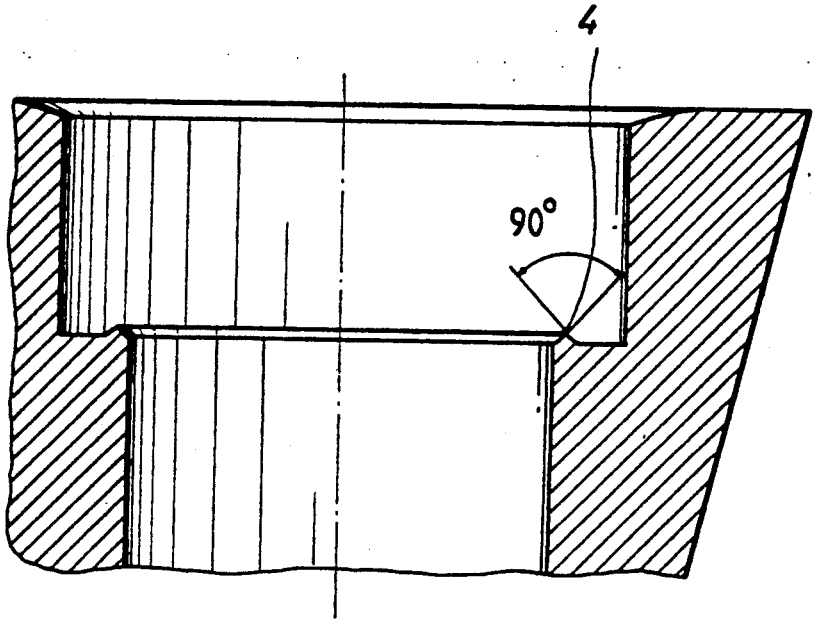
FIG. 12 is a fragmentary cross sectional view of the nozzle body of FIG. 9 on a larger scale.
Figure 14:
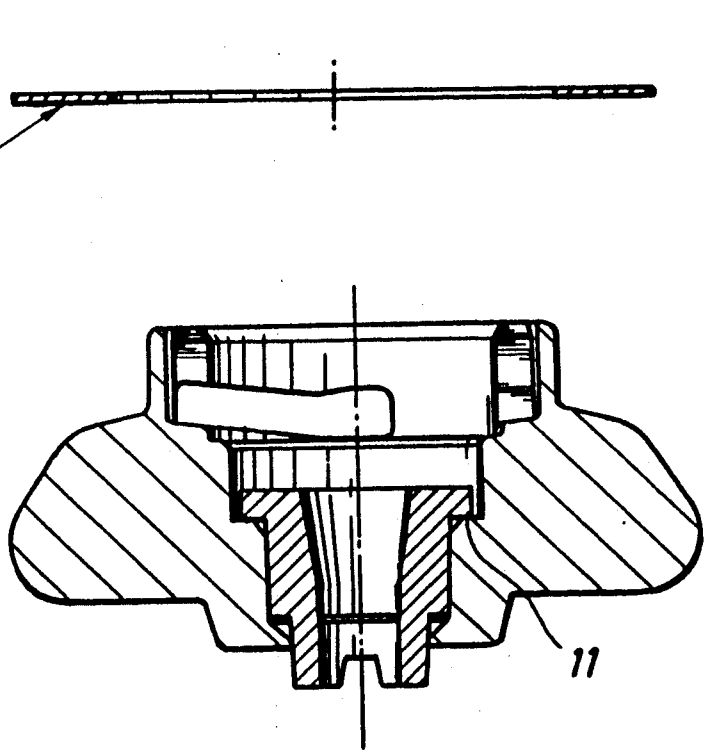
FIG. 14 is a longitudinal cross sectional view of the nozzle body mounted in the union.
Figure 13:
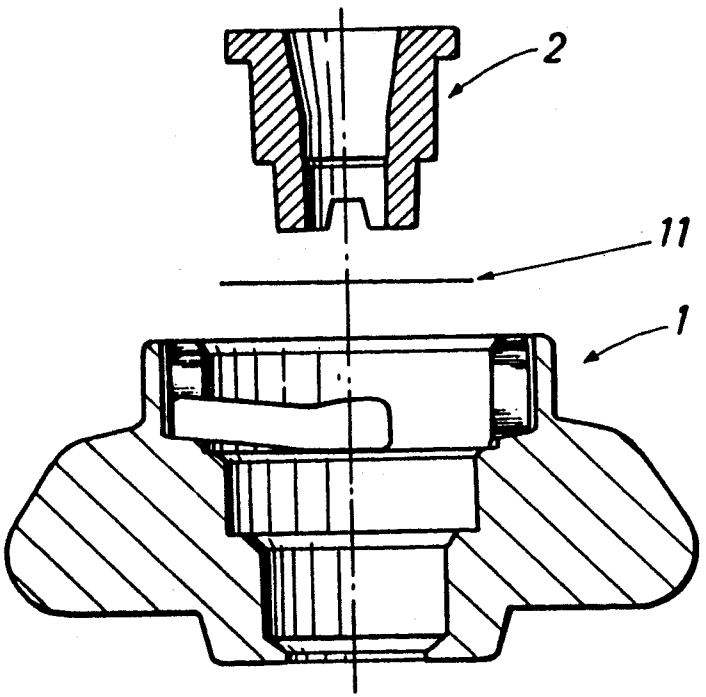
FIG. 13 is an exploded sectional view illustrating how the nozzle body can be fastened to the union by means of a metal sealing disk.

The union 1 of FIGS. 1 to 5 for a nozzle body of a spray nozzle, especially for spraying liquid manure, is made of plastics by mold casting. A nozzle body 2, of FIG. 6 can be inserted in the union and is also made of plastics. The nozzle body 2 can be fastened to the union by way of ultrasonic welding, and ultrasonic welding being performed at the circumferential rim 4 shown in FIG. 12, for instance at a vibration frequency of 1 to 100 kHz. The pressure above the welding spot is approximately 200 psi. A particular advantage of ultrasonic welding is that it can be adjusted to circumferential welding spots. The union 1 is furthermore provided with a bayonet socket for the securing to the discharge pipe discharging the liquid to be sprayed out. The securing could be performed by a manual turning of projecting wings 5 on the union. The bayonet socket comprises two vertical grooves 6 followed by inner recesses 7 extending along a helical line. The recesses 7 are through as the union cannot otherwise be made of plastics. If the recesses were not through, very complicated tools would have been required for the manufacturing. Each nozzle provides a fan spray of about 110°. The spray nozzles are mutually spaced approximately 0.5 m along a spray bar for an agricultural tool to a predetermined degree. To avoid collisions of the spray fans, said spray fans have been turned a little in relation to the spray bar. The planar sides of the opening 8 in the bottom of the union, as shown in FIG. 3, have been turned about 8° relative to the spray bar and collisions of the spray fans are thereby avoided. As a result, a substantially uniform distribution or material sprayed out is obtained. The spray fans would collide if the nozzles were aligned instead of being slightly turned relative to one another.

Figure 9:
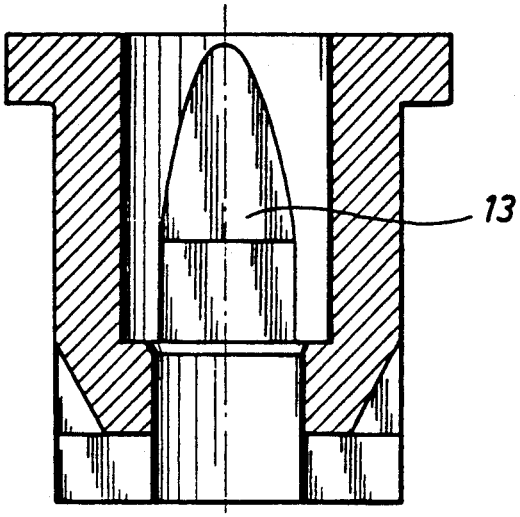
FIG. 9 is a longitudinal cross sectional view of the nozzle body of FIG. 8 turned 90°.
Figure 11:
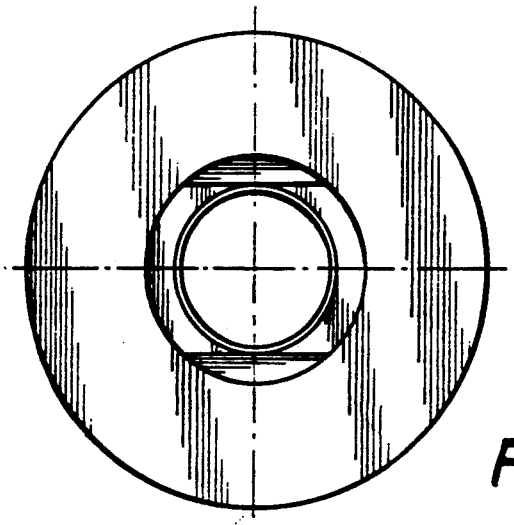
FIG. 11 is a bottom plan view of the nozzle body of FIG. 9.
Figure 18:
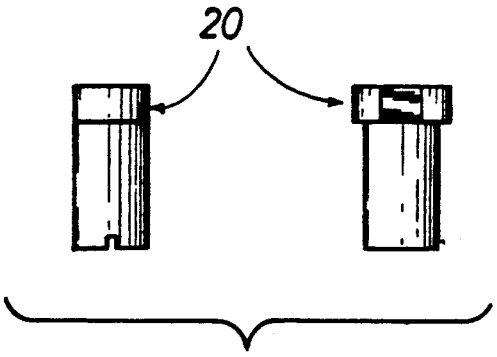
FIG. 18 is a lateral view of a ceramic nozzle in two different positions turned 90° in relation to each other.

The nozzle body 2 inserted in the union 1 comprises a through opening with two oblique, inner surfaces 13, as shown in FIG. 9. These inner surfaces 13 serve as guide surfaces for ceramic nozzle shown in FIG. 18 which have planar outer surfaces 20 pressed and positioned in the openings of the nozzle body 2. The outer surfaces 13, 20 are parabolic, corresponding to a plane intersecting a cylindrical surface. The two parts must be mutually dense, which is obtained by the surfaces being formed with a cone angle of approximately 1°. As a result, the necessary sealing is obtained. It is possible to choose between a ceramic nozzle and a plastic nozzle. A ceramic nozzle is more expensive to manufacture, but presents a higher wearability. A plastic nozzle can, however, be more accurately manufactured. When no maintenance is desired, the ceramic nozzles are advantageously used.

According to an alternative embodiment, the union and the nozzle holder are cast in one piece. Then only the nozzle body is to be pressed into the nozzle holder now formed integral with the union. Also in the latter case, the nozzle body is made either of plastics or ceramics.

The union is of a height of approximately 25 mm.

According to an alternative embodiment, a sealing disk 11 is situated below the projecting collar 16 of the nozzle body 2 and encircles the nozzle body 2, said disk 11 being made of metal. When the nozzle body 2 with the metal sealing disk 11 is pressed into the union 1, the disk 11 cuts into the inner wall of the union 1, said disk 11 being of an outer diameter exactly mating or slightly larger than the inner diameter of the union 1. The latter way of securing is preferred to the ultrasonic welding.

Figure 15:
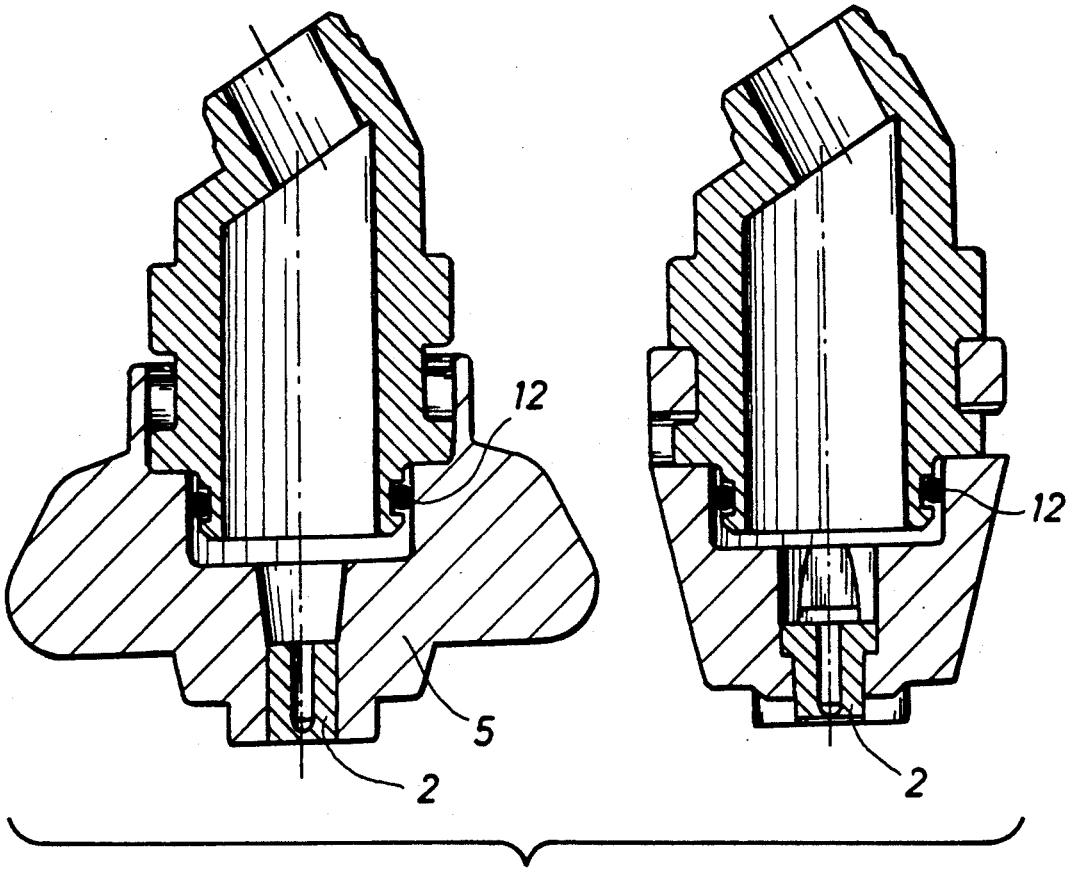
FIG. 15 is a longitudinal cross sectional view of the pipe stud and union with a circumferential O-ring seal of elastomeric material.

During the mounting of a spray nozzle to a discharge pipe stub of the distributor pipes in question, a sealing can optionally be provided by means of a circumferential O-ring 12 of elastomeric material which is able to stand up to a high pressure, CF. FIG. 15. Then the resilience during the securing of the spray nozzle is provided by means of the bayonet socket means engaging projecting pins of the discharge pipe stub. A resilient securing during the mounting is then provided by means of bayonet socket means one-sidedly secured. In this manner, the properties of the plastics are utilized for providing the desired securing force.

Figure 16:
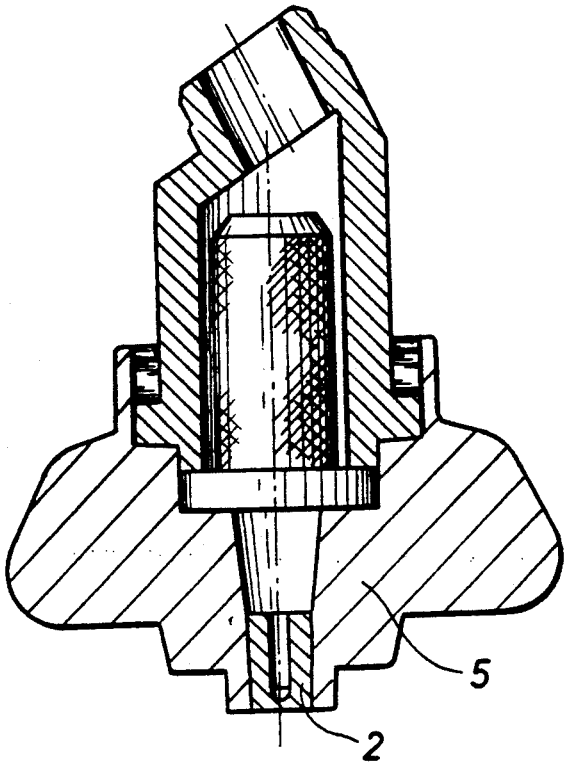
FIGS. 16 and 17 are views similar to FIG. 15 illustrate a sealing provided by an axially compressed rubber packing.
Figure 17:
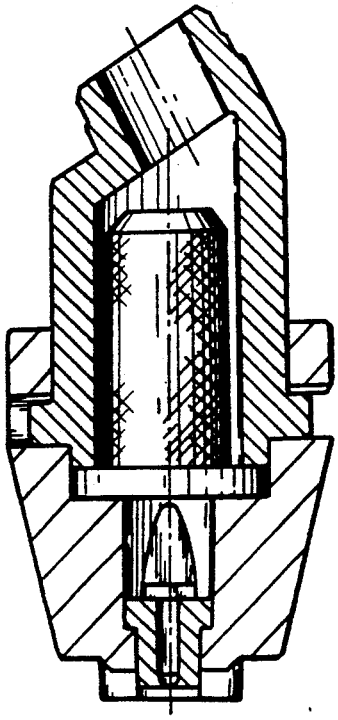

In the latter embodiment, a filter may be inserted in the nozzle as shown in FIGS. 16 and 17.

I claim:

1. A spray nozzle assembly adapted for dye coding and disconnect attachment to a pipe stud, said nozzle assembly comprising a unitary nozzle body, a union member mounting said body, said union member having a through opening with a surrounding wall and with one end for receiving the pipe stud and an opposite end receiving said nozzle body, said through opening having a radial shoulder between said ends facing the pipe receiving end, said nozzle body having a radial flange facing the nozzle receiving end of the opening, a circumferential metal sealing disc surrounding said nozzle body under said flange and projecting radially therefrom into cutting engagement with the surrounding wall of the through opening between the flange and shoulder to sealingly connect the union and nozzle body whereby the assembly provides a quick disconnect unit for said pipe stud.

2. The assembly of claim 1, wherein said union has a bayonet slot connection for the pipe stud.

3. The assembly of claim 1, including a resilient seal in the stud receiving end of the through opening of the union.

4. The assembly of claim 1, wherein the through opening of the union and the periphery of the nozzle body have cooperating side surfaces to facilitate pressing of the nozzle body into the union.

* * * * *